US012127593B2

(12) United States Patent
Hupkes

(10) Patent No.: US 12,127,593 B2
(45) Date of Patent: Oct. 29, 2024

(54) AEROSOL GENERATION DEVICE

(71) Applicant: JT International S.A., Geneva (CH)

(72) Inventor: Ernst Hupkes, Kampen (NL)

(73) Assignee: JT International S.A. (CH)

( * ) Notice: Subject to any disclaimer, the term of this patent is extended or adjusted under 35 U.S.C. 154(b) by 364 days.

(21) Appl. No.: 17/621,519

(22) PCT Filed: Aug. 7, 2020

(86) PCT No.: PCT/EP2020/072307
§ 371 (c)(1),
(2) Date: Dec. 21, 2021

(87) PCT Pub. No.: WO2021/023880
PCT Pub. Date: Feb. 11, 2021

(65) Prior Publication Data

US 2022/0346447 A1 Nov. 3, 2022

(30) Foreign Application Priority Data

Aug. 8, 2019 (EP) ..... 19190860

(51) Int. Cl.
*A24F 40/46* (2020.01)
*A24F 40/20* (2020.01)

(52) U.S. Cl.
CPC ..... *A24F 40/46* (2020.01); *A24F 40/20* (2020.01)

(58) Field of Classification Search
CPC ..... A24F 40/46; A24F 40/20; A24F 40/40; A24F 40/60; A24F 40/50; H02J 7/0063; H02M 1/0003
See application file for complete search history.

(56) References Cited

U.S. PATENT DOCUMENTS

| | | | | |
|---|---|---|---|---|
| 11,918,045 | B2 * | 3/2024 | Hijma | A24F 40/40 |
| 2018/0070636 | A1 | 3/2018 | Ruscio et al. | |
| 2018/0310628 | A1 | 11/2018 | Qiu | |
| 2018/0338541 | A1 | 11/2018 | Worm et al. | |
| 2019/0166914 | A1 * | 6/2019 | Qiu | A24F 40/40 |

(Continued)

FOREIGN PATENT DOCUMENTS

| | | | |
|---|---|---|---|
| CN | 105792686 | A | 7/2016 |
| CN | 108024576 | A | 5/2018 |

(Continued)

OTHER PUBLICATIONS

Search Report dated Nov. 15, 2023 from the Office Action for Taiwanese Application No. 109126907, pp. 1-2.

(Continued)

*Primary Examiner* — Truc T Nguyen
(74) *Attorney, Agent, or Firm* — Lerner David LLP

(57) ABSTRACT

An aerosol generation device includes an electrical power source; a heating chamber; a heater arranged to supply heat to the heating chamber; control circuitry configured to control the supply of electrical power from the electrical power source to the heater; a frame; and a housing having an internal volume containing the electrical power source, the heating chamber, the heater, the control circuity and the frame. The frame is arranged between a first volume of the internal volume containing the heater and the heating chamber, and a second volume of the internal volume containing the electrical power source.

13 Claims, 11 Drawing Sheets

(56) References Cited

U.S. PATENT DOCUMENTS

| | | | | |
|---|---|---|---|---|
| 2019/0200678 | A1 | 7/2019 | Thorson et al. | |
| 2019/0239568 | A1* | 8/2019 | Ouyang | H01M 50/579 |
| 2020/0000146 | A1* | 1/2020 | Anderson | A24F 40/90 |
| 2020/0113242 | A1* | 4/2020 | Novak, III | H01R 13/6205 |
| 2020/0305509 | A1* | 10/2020 | Chen | A24F 40/10 |
| 2022/0248762 | A1 | 8/2022 | Hupkes | |
| 2022/0338544 | A1* | 10/2022 | Chan | A61M 11/042 |
| 2023/0080936 | A1* | 3/2023 | Hupkes | H05K 1/14 131/329 |
| 2024/0057666 | A1* | 2/2024 | Prog | A24F 40/20 |

FOREIGN PATENT DOCUMENTS

| | | | |
|---|---|---|---|
| CN | 108882751 | A | 11/2018 |
| CN | 109480337 | A | 3/2019 |
| CN | 208875414 | U | 5/2019 |
| CN | 114126430 | A | 3/2022 |
| WO | 2015035510 | A1 | 3/2015 |
| WO | 2016150979 | A1 | 9/2016 |
| WO | 2019/047758 | A1 | 3/2019 |
| WO | 2019/080745 | A1 | 5/2019 |

OTHER PUBLICATIONS

International Search Report for Application No. PCT/EP2020/072307 mailed Oct. 5, 2020, pp. 1-5.

Search Report dated Feb. 29, 2024 from Office Action for Chinese Application No. 202080049865.0 issued Mar. 5, 2024. 3 pgs.

* cited by examiner

AEROSOL GENERATION DEVICE

CROSS-REFERENCE TO RELATED APPLICATIONS

The present application is a national phase entry under 35 U.S.C. § 371 of International Application No. PCT/EP2020/072307, filed Aug. 7, 2020, published in English, which claims priority to European Application No. 19190860.7 filed Aug. 8, 2019, the disclosures of which are incorporated herein by reference.

FIELD OF THE DISCLOSURE

The present disclosure relates to an aerosol generation device. The disclosure is particularly applicable to a portable aerosol generation device, which may be self-contained and low temperature. Such devices may heat, rather than burn, tobacco or other suitable aerosol substrate materials by conduction, convection, and/or radiation, to generate an aerosol for inhalation.

BACKGROUND TO THE DISCLOSURE

The popularity and use of reduced-risk or modified-risk devices (also known as vaporisers) has grown rapidly in the past few years as an aid to assist habitual smokers wishing to quit smoking traditional tobacco products such as cigarettes, cigars, cigarillos, and rolling tobacco. Various devices and systems are available that heat or warm aerosolisable substances as opposed to burning tobacco in conventional tobacco products.

A commonly available reduced-risk or modified-risk device is the heated substrate aerosol generation device or heat-not-burn device. Devices of this type generate an aerosol or vapour by heating an aerosol substrate that typically comprises moist leaf tobacco or other suitable aerosolisable material to a temperature typically in the range 150° C. to 300° C. Heating an aerosol substrate, but not combusting or burning it, releases an aerosol that comprises the components sought by the user but not the toxic and carcinogenic by-products of combustion and burning. Furthermore, the aerosol produced by heating the tobacco or other aersolisable material does not typically comprise the burnt or bitter taste resulting from combustion and burning that can be unpleasant for the user and so the substrate does not therefore require the sugars and other additives that are typically added to such materials to make the smoke and/or vapour more palatable for the user.

It is desirable to provide a device with improved safety and/or reliability.

In particular, in such aerosol generation devices, the aerosol substrate must be heated by a heater and it is inevitable that some heat will leak from the heater into the rest of the aerosol generation device. This heat may damage other components such as a power source of the heater or heat-sensitive electronics. In some cases, this may even be dangerous with a risk of fire or explosion when components that are not designed to be heated become too hot.

Additionally, electrical power sources may experience leaks or degassing events where a fluid (liquid or gas) is produced from the electrical power source. These events can fall within normal behaviour of the power source, and do not necessarily compromise the functionality of the aerosol generation device. However, the fluid produced from such events may indirectly compromise functionality, for example by damaging fragile components of control circuitry or contaminating the heating chamber.

SUMMARY OF THE DISCLOSURE

According to a first aspect of the disclosure, there is provided an aerosol generation device comprising: an electrical power source; a heating chamber; a heater arranged to supply heat to the heating chamber; control circuitry configured to control the supply of electrical power from the electrical power source to the heater; a frame; and a housing having an internal volume containing the electrical power source, the heating chamber, the heater, the control circuity and the frame. The frame is arranged between a first volume of the internal volume containing the heater and the heating chamber, and a second volume of the internal volume containing the electrical power source.

By arranging the frame between the first volume containing the heater and the second volume containing the electrical power source, the electrical power source can be thermally shielded from any heat leaking from the heater and heating chamber, and the heater and heating chamber can be physically shielded from a fluid leak or degassing event from the electrical power source.

Optionally, the housing is an elongate housing for handholding, and the first volume, the frame and the second volume are each arranged along the elongate direction of the housing.

Optionally, the first volume contains a region of air or vacuum adjacent to the heating chamber.

Optionally, the heating chamber and the heater are held by the frame such that they do not touch the housing.

By preventing the heating chamber and heater from touching the housing, conduction of heat to the housing is inhibited, where such conduction could otherwise cause the housing to become painfully or even dangerously hot. This also protects the heater and heating chamber from external damage, for example in the case where the aerosol generation device is dropped.

Optionally, the electrical power source and the control circuitry are held by the frame.

Optionally, the control circuitry comprises a component mounted on a first PCB that is arranged along the frame and in the second volume.

By arranging the first PCB on a second volume side of the frame, the first PCB can be thermally shielded from the heater and heating chamber by the frame. This reduces the impact of any heat leaking from the heating chamber on the component mounted on the first PCB.

Optionally, the first PCB is a double-sided PCB.

Optionally, the aerosol generation device further comprises a second

PCB that is arranged along the frame and between the first volume and the second volume.

The substrate of the second PCB will act as additional heat shielding to protect the control circuitry in the second volume.

Optionally, the second PCB is a single-sided PCB and the control circuitry further comprises a component mounted on the second PCB and in the second volume.

Since one side of the second PCB may be exposed to heat leaking from the heater and heating chamber in the first volume, it is advantageous for the second PCB to be a single sided PCB, with components of the control circuitry being mounted at most on the side of the second PCB that is in the second volume.

Optionally, the first PCB and the second PCB are connected by a flexible PCB portion, and the first PCB, the second PCB and the flexible PCB portion are arranged around the frame.

This usage of a flexible PCB portion not only means that, when one of the first and second PCBs is fixed, the other is easily guided into a correct position, but also means that a larger area for control circuitry can be easily printed once and at the same time divided among multiple surfaces in order to fit the control circuitry into an irregular space and reduce the space required for the control circuitry, and helps to reduce the volume of the aerosol generation device.

According to a second aspect of the disclosure, there is provided an aerosol generation device, comprising: an electrical power source; a heating chamber; a heater arranged to supply heat to the heating chamber; control circuitry configured to control the supply of electrical power from the electrical power source to the heater; a frame; and a housing having an internal volume containing the electrical power source, the heating chamber, the heater, the control circuity and the frame. The frame is arranged between a third volume of the internal volume containing the heater, the heating chamber and the control circuitry, and a fourth volume of the internal volume containing the electrical power source.

Optionally, the frame is arranged to prevent fluid flow from the fourth volume to the third volume.

This protects the heater, the heating chamber and the control circuitry from potential damage or contamination due to degassing or leaking by the electrical power source.

Optionally, the housing is an elongate housing for handholding, and the third volume, the frame and the fourth volume are each arranged along the elongate direction of the housing.

Optionally, the electrical power source is held by the frame.

Optionally, the first and second aspects may be combined to provide an aerosol generation device comprising: a first frame, arranged between the first volume containing the heater and the heating chamber, and a fifth volume of the internal volume containing the control circuitry; and a second frame arranged between the fifth volume containing the control circuitry and the fourth volume containing the electrical power source.

This arrangement has the advantage that the control circuitry is protected from heat leaking from the heater sub-assembly and is protected from fluid produced from the electrical power source.

Optionally, the control circuitry comprises a component mounted on a PCB held between the first frame and the second frame.

DETAILED DESCRIPTION

As an overview of an aerosol generation device according to an embodiment of the invention, FIGS. 1A, 1B, 2A and 2B illustrate a series of modular sub-assemblies which are assembled in the aerosol generation device. FIGS. 3A to 6B illustrate additional details of each of the sub-assemblies. It should be understood that many details of the embodiment are not relevant for explaining the claimed inventive aspects of the device, and thus, for conciseness some features shown in the figures are not described in detail, and, for simplicity, some features are removed entirely in certain figures in order to better illustrate the features relevant for understanding and implementing the invention.

Figure 1A:
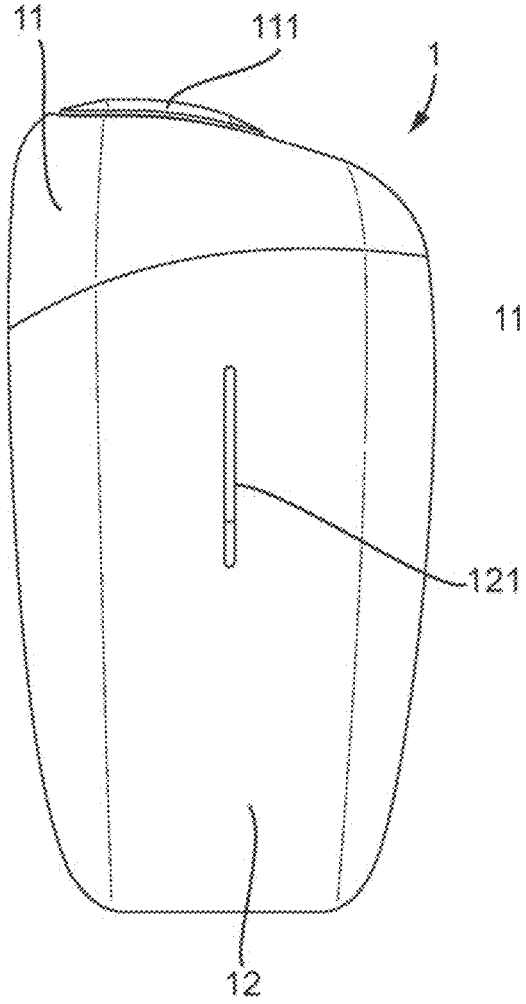
FIGS. 1A and 1B are schematic views of an aerosol generation device.

Referring to FIG. 1A, according to an embodiment of the invention, an aerosol generation device 1 comprises an access sub-assembly 11 and a housing sub-assembly 12.

The aerosol generation device 1 has an overall elongate and pebble-like shape, with a top end at which an aerosol is provided, a bottom end opposed to the top end, and four sides between the bottom end and the top end in a substantially quadrilateral arrangement of two larger opposing sides and two smaller opposing sides.

The access sub-assembly 11 is at the top end and comprises means for opening and closing access to a heating chamber inside the aerosol generation device 1, in order for a user to, for example, supply an aerosol substrate such as tobacco to be heated in the heating chamber, obtain the generated aerosol and clean the heating chamber. In this embodiment, the access means has a lid 111 attached to a slider mechanism.

The housing sub-assembly 12 provides a housing for internal components of the aerosol generation device 1 including an electrical power source, a heating chamber, a heater, control circuitry and a frame, and provides at least part of the sides and bottom end of the aerosol generation device 1. In this embodiment, the housing is an elongate housing for handholding, although the benefits of the invention may also be achieved in aerosol generation devices 1 which are not adapted for handholding. Additionally, as illustrated in a central linear region 121 of the housing sub-assembly 12 of FIG. 1A, in this embodiment, the aerosol generation device 1 includes one or more indicators (e.g. lights) and one or more inputs (e.g. buttons) for controlling the aerosol generation device. In embodiments with indicator(s) or input(s), the housing sub-assembly may comprise a translucent part or a tactile part, or may simply comprise a gap allowing access to internal indicator(s) and input(s).

Figure 1B:
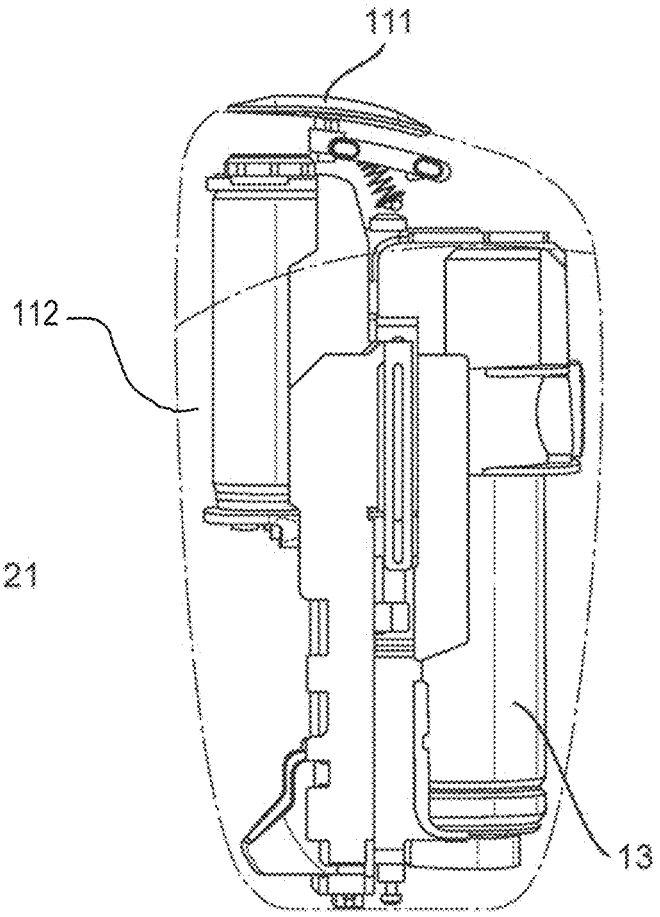

Referring to FIG. 1B, in this schematic view, the access sub-assembly 11 and housing sub-assembly 12 are represented as "transparent" (illustrated with dashed line edges) and it can be seen that the aerosol generation device 1 further comprises an intermediate sub-assembly 13 housed within the access sub-assembly 11 and the housing sub-assembly 12.

Figure 2A:
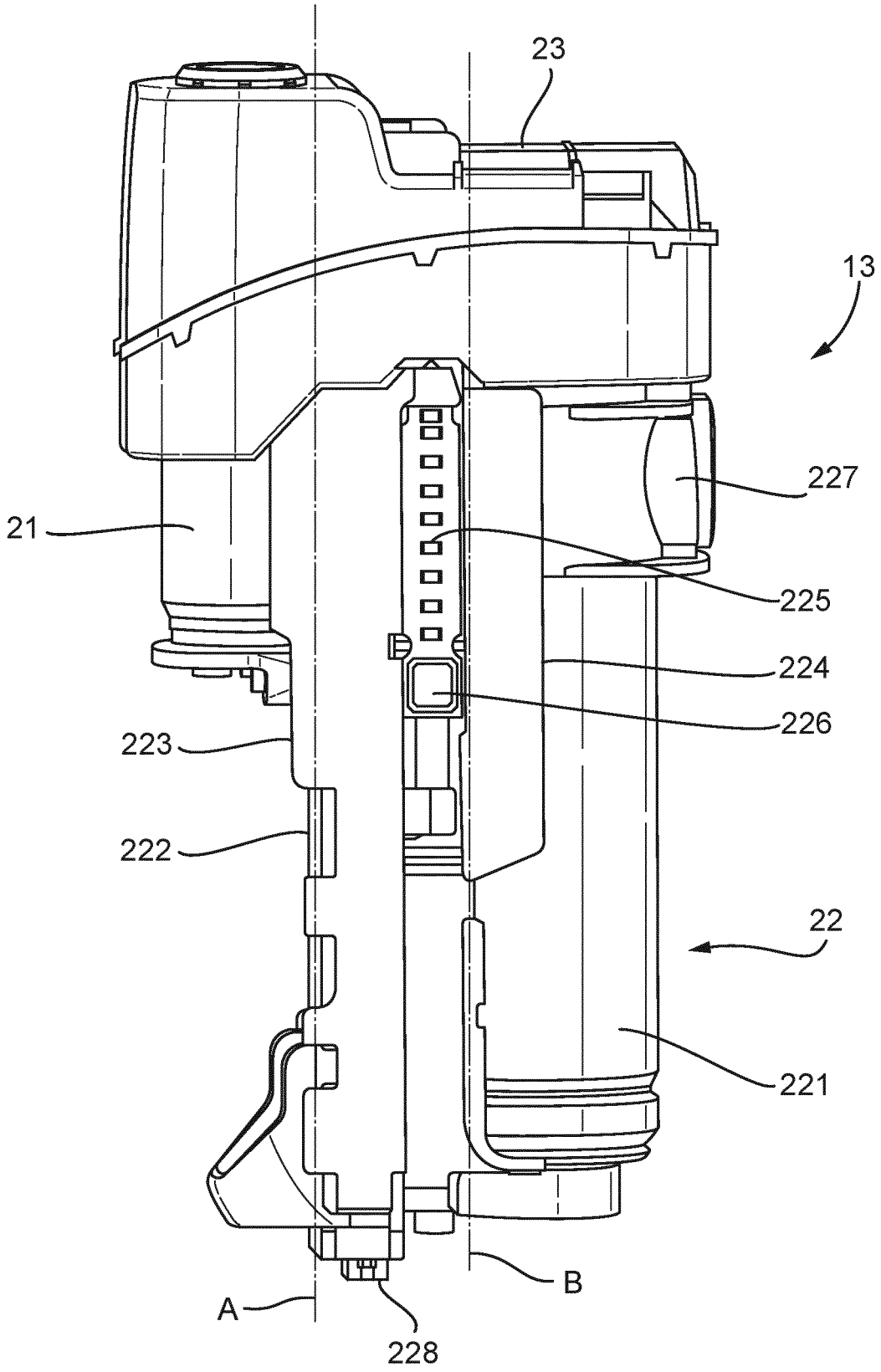
FIGS. 2A and 2B are schematic views of an intermediate sub-assembly and a housing sub-assembly.
Figure 2B:
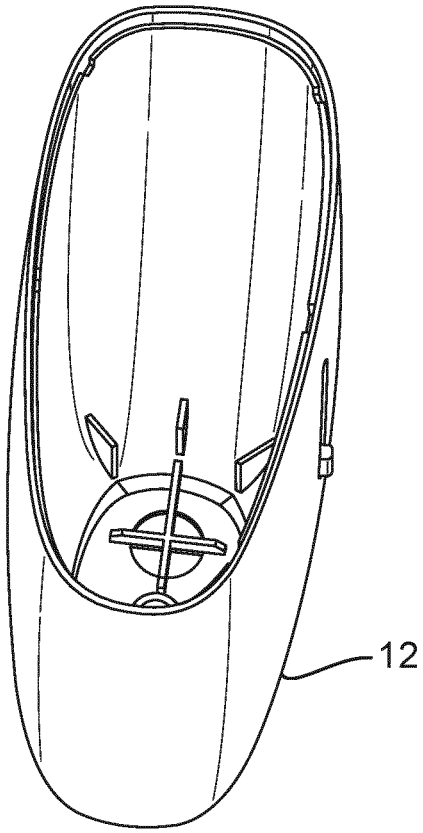

Details of the intermediate sub-assembly 13 are shown schematically in FIG. 2A, and the internal volume of the housing sub-assembly is shown schematically in FIG. 2B.

Referring to FIG. 2A, the intermediate sub-assembly 13 comprises a heater sub-assembly 21 fixed against a power-and-control sub-assembly 22.

The heater sub-assembly 21 comprises a heater and a heating chamber, where the heater is arranged in the heater sub-assembly to supply heat to the heating chamber. The heater sub-assembly is described in more detail below by reference to FIG. 5.

The power-and-control sub-assembly 22 comprises an electrical power source 221, in this case a battery. The power-and-control sub-assembly 22 further comprises control circuitry 222 configured to control the supply of electrical power from the electrical power source to the heater. In this embodiment, the control circuitry 222 is mounted on a plurality of PCBs as described below.

The electrical power source 221 and the control circuitry 222 are supported by a heater sub-assembly support frame 223 and an electrical power source support frame 224.

The heater sub-assembly support frame 223 is arranged to divide an internal volume of the housing sub-assembly 12 into a first volume and a second volume. The first volume contains the heater sub-assembly 21 including the heater and the heating chamber. The first volume contains a region 112 of air or vacuum adjacent to the heating chamber. The second volume contains the electrical power source 221. As shown in FIG. 2A and FIG. 1B, in this embodiment, the first volume, the heater sub-assembly support frame 223 and the second volume are each arranged along an elongate direction of the housing of housing sub-assembly 12 although, as mentioned above, not all embodiments of the invention are elongate, and in such non-elongate embodiments, the heater sub-assembly support frame 223 may be arranged in any way which divides the internal volume of the housing into the first volume and second volume. This division is schematically illustrated in FIG. 2A using the dashed line A, with the first volume being to the left of line A in the Figure, and the second volume being to the right of line A in the Figure. With this arrangement, in addition to supporting the heater sub-assembly 21, the heater sub-assembly support frame 223 has the effect of shielding the electrical power source 221 from any heat leaking from the heater sub-assembly 21. The heater sub-assembly support frame 223 is optionally made of a thermally insulating material in order to insulate the control circuitry 222 and the electrical power source 221 from the heater sub-assembly 21, although the combined frame and shielding effects are achieved with only mildly thermally insulating materials such as plastics. The heater sub-assembly support frame 223 and electrical power source support frame 224 may, for example, comprise PA (Polyamide) and/or PEEK (Polyether ether ketone).

Additionally, in this embodiment, the heater sub-assembly 21, comprising the heating chamber and the heater, is held by the heater sub-assembly support frame 223 such that neither of the heating chamber and the heater touch the housing of the housing sub-assembly 12. The means for holding the heater sub-assembly 224 are described further below with reference to FIGS. 3 and 4. This inhibits conduction of heat from the heater sub-assembly to the housing, where such conduction could otherwise cause the hand-held housing to become painfully or even dangerously hot. This also protects the heater sub-assembly 21 from external damage, for example in the case where the aerosol generation device 1 is dropped. However, these benefits are separate from the volume-dividing feature, and some embodiments may omit the features of the heater sub-assembly support frame 223 holding and suspending the heater and/or the heating chamber.

The electrical power source support frame 224 is arranged to divide the internal volume of the housing sub-assembly 12 into a third volume and a fourth volume. The third volume contains the heater sub-assembly 21 including the heater and the heating chamber, and also contains the control circuitry 222. The fourth volume contains the electrical power source 221. As shown in FIG. 2A and FIG. 1 B, in this embodiment, the third volume, electrical power source support frame 224 and the fourth volume are each arranged along an elongate direction of the housing of housing sub-assembly 12 although, as mentioned above, not all embodiments of the invention are elongate, and in such non-elongate embodiments, the electrical power source support frame 224 may be arranged in any way which divides the internal volume of the housing into the third volume and the fourth volume. This division is schematically illustrated in FIG. 2A using the dashed line B, with the third volume being to the left of line B in the Figure, and the fourth volume being to the right of line B in the Figure. With this arrangement, in addition to supporting the electrical power source 221, the electrical power source support frame 224 has the effect of preventing fluid flow from the fourth volume to the third volume. This protects the heater, the heating chamber and the control circuitry from potential damage or contamination due to degassing or leaking by the electrical power source 221.

Additionally, in this embodiment, the electrical power source 221 is held by the electrical power source support frame 224 such that the electrical power source 221 does not touch the housing of the housing sub-assembly 12. The electrical power source 221 may be held by, for example, an adhesive such as glue, a soldered bond that also forms an electrical contact, or by mechanical connections such as a snap fit. Not touching the housing ensures that there is space for degassing or leaks to occur during normal operation of the electrical power source 221, even when the electrical power source support frame 224 prevents such leaks from expanding or flowing into the third volume. This also protects the electrical power source 221 from external damage, for example in the case where the aerosol generation device 1 is dropped. However, these benefits are separate from the volume-dividing feature, and some embodiments may omit the features of the electrical power source support frame 224 holding and suspending the electrical power source 221.

With the above combination of divisions by the heater sub-assembly support frame 223 and the electrical power source support frame 224, a middle fifth volume is defined as the overlap between the second and third volumes, such that, across the aerosol generation device 1 as shown in FIG. 1B, the first volume containing the heater and the heating chamber is on one side of the heater sub-assembly support frame 223, the fifth volume containing the control circuitry 222 is between the heater sub-assembly support frame 223 and the electrical power source support frame 224, and the fourth volume containing the electrical power source 221 is on the other side of the electrical power source support frame 224. However, it should be noted that, although both are present in this embodiment, only one of the heater sub-assembly support frame 223 and the electrical power source support frame 224 is required, and the other may be omitted in alternative embodiments.

As additionally shown in FIG. 2A, the power-and-control sub-assembly 22 may comprise an indicator array 225 of one or more indicators (e.g. LEDs) for indicating a state of the device and one or more inputs 226 (e.g. tactile switches) corresponding to the central linear region 121 of the housing sub-assembly 12 of FIG. 1A. The power-and-control sub-assembly 22 may further comprise a vibrator sub-assembly 227 to provide a further indication of the state of the device. Furthermore, the power-and-control sub-assembly 22 may comprise an external electrical connector 228 for charging the electrical power source 221 and optionally also for communicating data to or from the control circuitry 222.

Furthermore, as shown in FIG. 2A, in this embodiment a space is left next to the heater sub-assembly 21 in the first volume. This space corresponds to the part of the aerosol generation device 1 which is most vulnerable to heat leaking from the heater sub-assembly 21 and is left empty to avoid exposing vulnerable components to leaking heat. This empty space may be held as a vacuum (where "vacuum" here includes air at substantially less than standard pressure) in order to limit convective heat conduction from the heater sub-assembly 21. Alternatively, this empty space may be filled with air. In that case, air may be allowed to flow between the empty space and the outside of the aerosol generation device 1, in mitigate the effect of heat leaking internally from the heater sub-assembly 21.

As shown in FIG. 2B, the housing sub-assembly 12 is substantially hollow in order to house at least a part of the intermediate sub-assembly 13. As can be seen in FIG. 1B, in this embodiment, the intermediate sub-assembly 13 extends out of the housing sub-assembly 12 and is partially housed by the access sub-assembly 11. In other embodiments, the intermediate sub-assembly 13 may fit entirely within the housing sub-assembly 12.

Figure 3A:
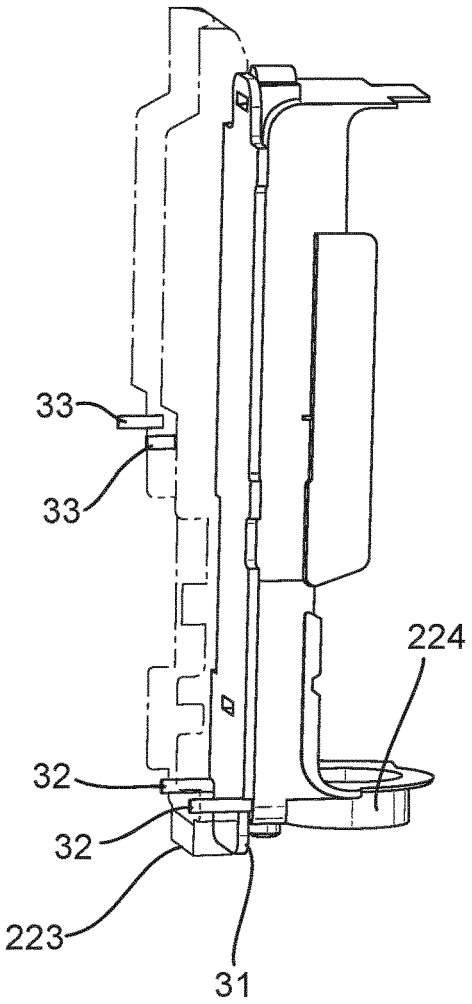
FIGS. 3A and 3B are schematic views of a part of the intermediate sub-assembly.
Figure 3B:
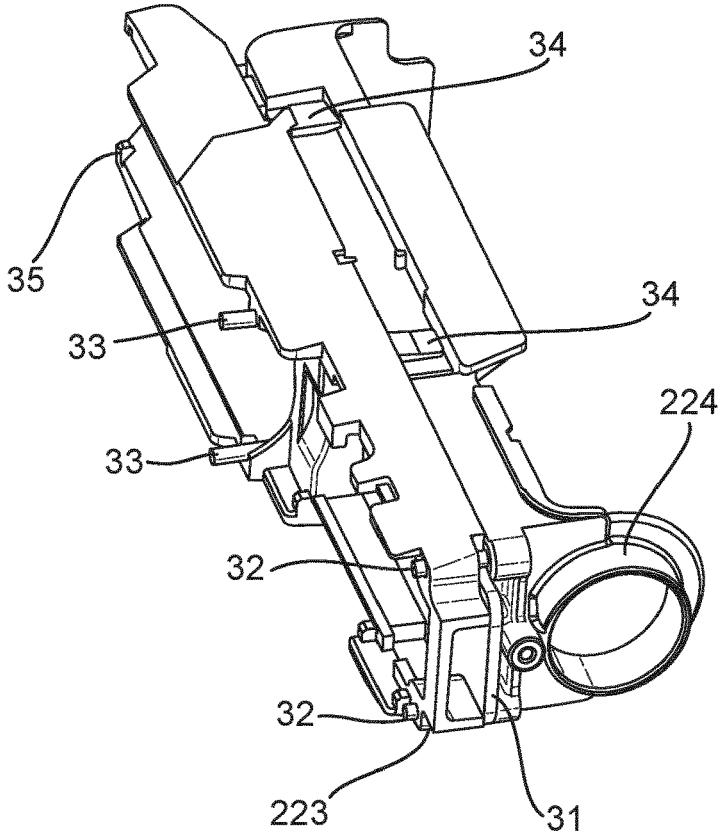

Referring now to FIGS. 3A and 3B, part of the power-and-control sub-assembly of an embodiment is shown. This may or may not actually represent a stage in manufacturing a corresponding aerosol generation device, but is particularly included here in order to show details of the power-and-control sub-assembly of this embodiment. In the view of FIG. 3A, the heater sub-assembly support frame 223 and the electrical power source support frame 224 are represented as "transparent" using dashed lines, so that a first PCB 31 can be seen between the two frames, arranged along the length of the heater sub-assembly support frame 223. On the other hand, FIG. 3B gives a solid view showing that the first PCB 31 is partly enclosed between the heater sub-assembly support frame 223 and the electrical power source support frame 224.

In this embodiment, the heater sub-assembly support frame 223 and the electrical power source support frame 224 are aligned with each other on either side of the first PCB 31. This arrangement has the advantage that the first PCB 31 is in the second volume (protected from heat leaking from the heater sub-assembly 21) and is in the third volume (protected from fluid produced from the electrical power source 221). Accordingly, one or more fragile components (i.e. components that are heat sensitive or sensitive to fluids that may be produced by an electrical power source) of the control circuitry 222 can be arranged on one or both sides of the first PCB 31 and, in order to make the most of the surface area of the first PCB 31, this PCB can be a double-sided PCB. For example, the first PCB 31 may have a processor chip or a memory chip mounted thereon.

To assist in aligning the heater sub-assembly support frame 223 and the electrical power source support frame 224, in this embodiment, the heater sub-assembly support frame 223 and the electrical power source support frame 224 include respective first guide members 32 and 32' which fit together when the frames are correctly aligned. For example, the first guide members 32 and 32' may be protrusions or pins, and corresponding recesses or holes. In other embodiments, additionally or instead, the first PCB 31 may have first guide members for aligning the first PCB 31 with respective first guide members of the heater sub-assembly support frame 223 and/or the electrical power source support frame.

To assist in aligning the power-and-control sub-assembly 22 with the heater sub-assembly 21, the heater sub-assembly support frame also includes second guide members 33, 35 adapted to fit with corresponding second guide members on the heater sub-assembly 21.

Additionally, in this embodiment, the power-and-control sub-assembly is formed using snap fit connectors 34 which attach the heater sub-assembly support frame 223 to the electrical power source support frame 224 and thereby hold the first PCB 31 in place.

Figure 4A:
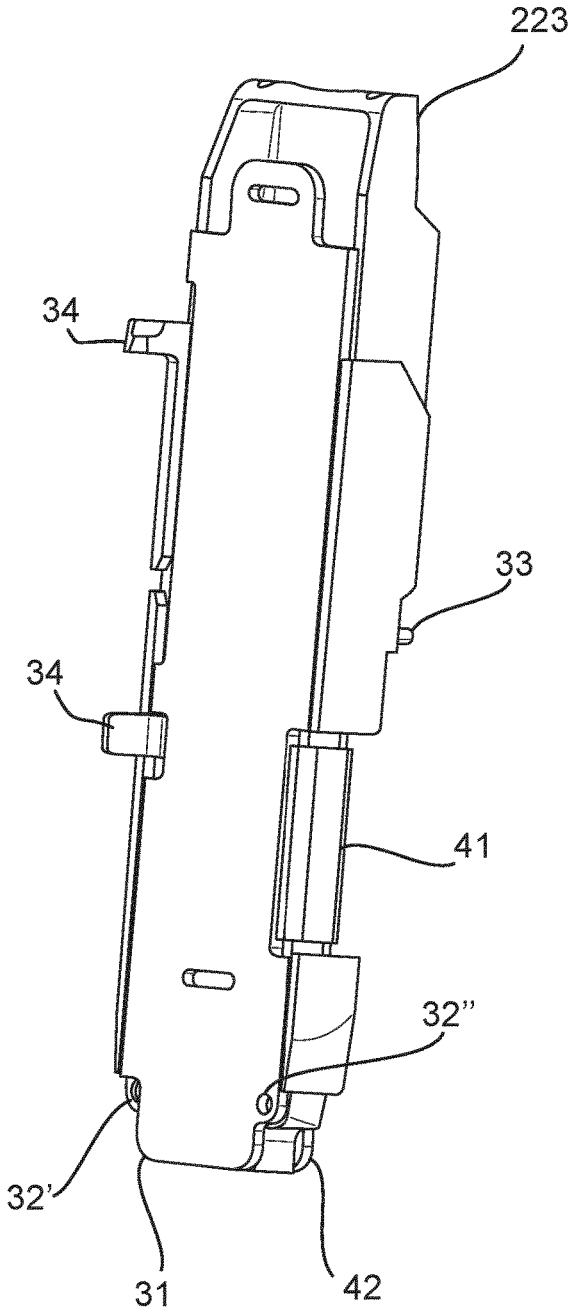
FIGS. 4A, 4B, 4C and 4D are schematic views of another part of the intermediate sub-assembly.
Figure 4B:
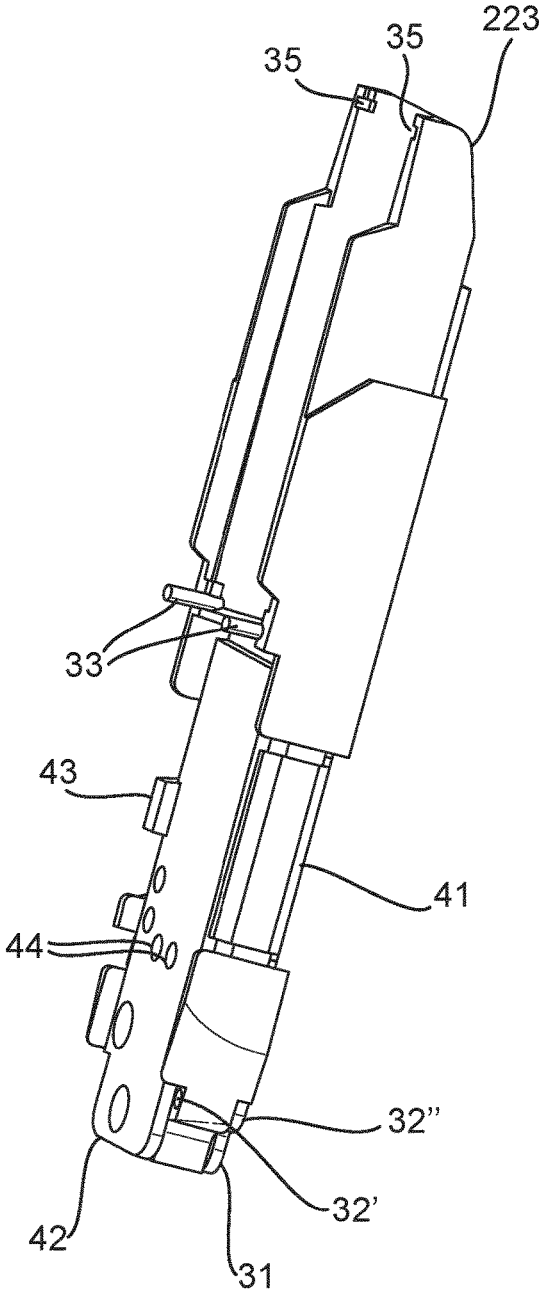
Figure 4C:
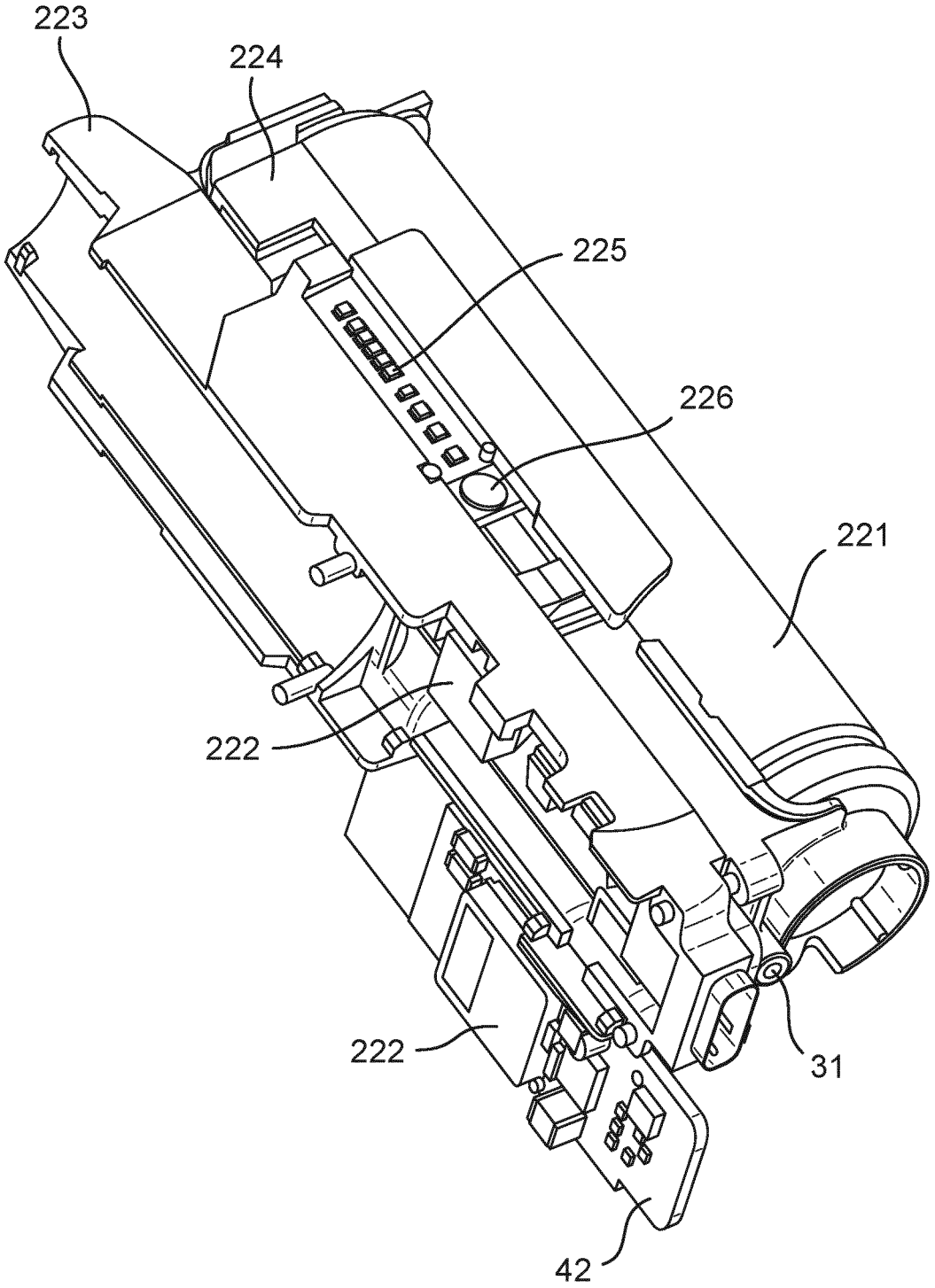
Figure 4D:
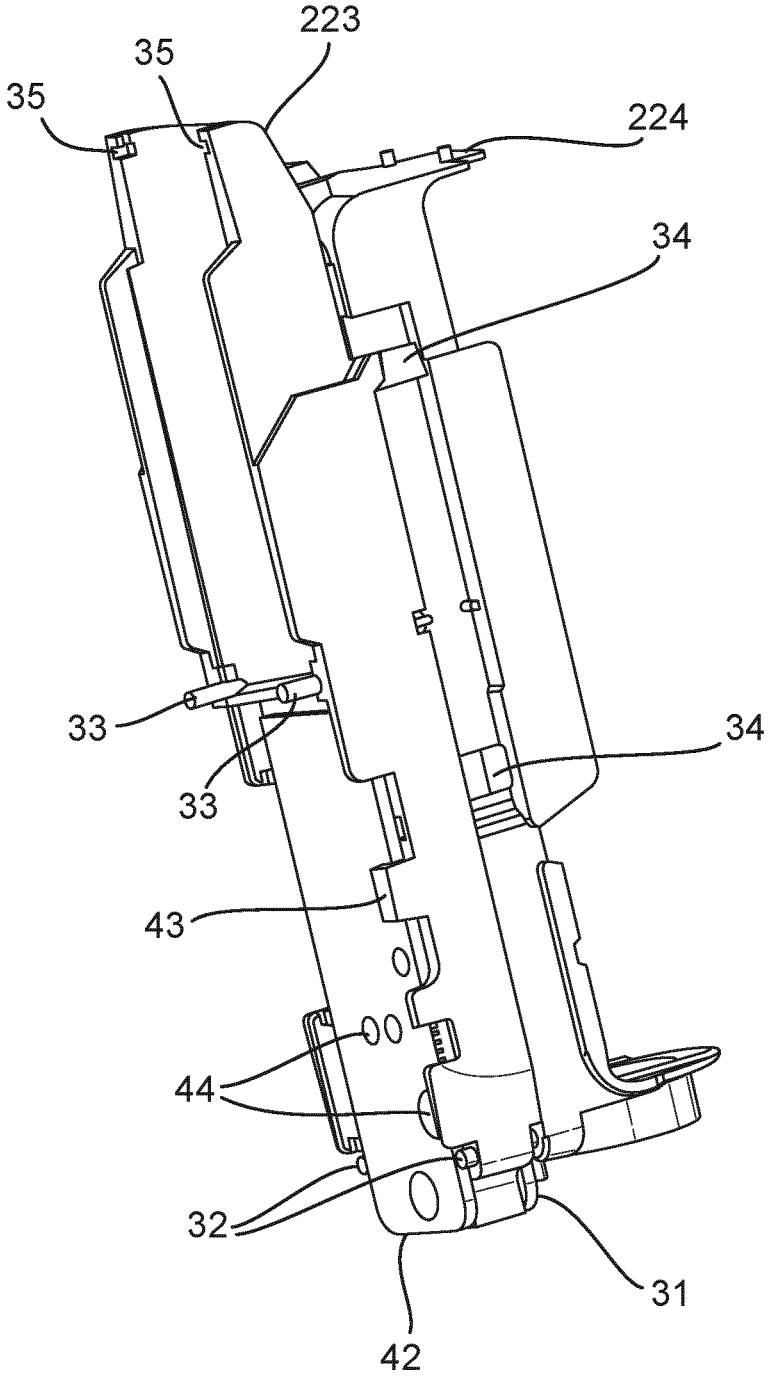

Referring now to FIGS. 4A, 4B, 4C and 4D, another part of the power-and-control sub-assembly is shown from various viewpoints around the assembly. As with FIGS. 3A and 3B, this may or may not actually represent a stage in manufacturing a corresponding aerosol generation device, but is particularly included here in order to show details of the power-and-control sub-assembly of this embodiment. The electrical power source support frame 224 is shown in FIGS. 4C and 4D but omitted in FIGS. 4A and 4B. In order to make sense of the comparison between these figures, it should be noted that FIG. 4B is horizontally reflected with respect to FIGS. 4A, 4C and 4D, in order to more effectively show a flexible PCB portion 41.

As shown in FIGS. 4A-D, the power-and-control sub-assembly 22 of this embodiment comprises the first PCB 31, a second PCB 42, and the flexible PCB portion 41, the first and second PCBs 31, 42 being connected to each other by the flexible PCB portion 41. Each of the first PCB 31 and the second PCB 42 have one or more components of the control circuitry 222 mounted thereon. The power-and-control sub-assembly 22 may comprise further PCBs in this embodiment, for example hosting the indicator array 225 and input 226 shown in FIG. 2A and 4C.

The flexible PCB portion 41 is wrapped around the heater sub-assembly support frame 223 and the second PCB 42 is attached to the heater sub-assembly support frame 223 such that the heater sub-assembly support frame 223 is between the first PCB 31 and the second PCB 42. This usage of a flexible PCB portion not only means that, when one of the first and second PCBs 31, 42 is fixed, the other is easily guided into a correct position, but also means that a larger area for control circuitry 222 can be easily printed once and at the same time divided among multiple surfaces in order to fit the control circuitry 222 into an irregular space and reduce the space required for the control circuitry 222, and helps to reduce the volume of the aerosol generation device 1.

FIG. 4A also shows an example of a first guide member 32" in the first PCB 31, described above as an addition or alternative to first guide members 32 and 32' in the heater sub-assembly support frame 223 and the electrical power source support frame 224.

As shown in FIGS. 4B, 4C and 4D, the second PCB 42 is arranged along the heater sub-assembly support frame 223 to form part of the divide between the first volume and the second volume. In other words, one side of the second PCB 42 is exposed to the first volume where it may be exposed to heat leaking from the heater sub-assembly 21 and the other side of the second PCB 42 is either against, or facing a gap in, the heater sub-assembly support frame 223. Since one side of the second PCB 42 may be exposed to leaking heat, it is advantageous for the second PCB 42 to be a single sided PCB, with components of the control circuitry 222 being mounted at most on the side of the second PCB 42 that is in the second volume. The substrate of the second PCB 42 will then act as heat shielding to protect the control circuitry 222 in the second volume. Nevertheless, in order to make some use of the side of the second PCB 42 that faces the first volume, this face may be provided with electrical contacts 44 for testing and/or for connection to the heater sub-assembly 21. These contacts 44 remain exposed when the power-and-control sub-assembly 22 is complete, making it easier to test the power-and-control sub-assembly and to make electrical connections between the heater sub-assembly 21 and the power-and-control sub-assembly 22. The heater sub-assembly support frame 223 may additionally comprise snap fit connectors 43 for attaching the second PCB 42 to the frame.

FIG. 4C illustrates a gap in the heater sub-assembly support frame 223, through which components of the control circuitry 222 mounted on the first PCB 31 can be seen, before the second PCB 42 has been attached to the heater sub-assembly support frame. At this stage of assembly, the first PCB 31 is nevertheless attached to the second PCB 42 by the flexible PCB portion 41. FIG. 4C also illustrates components of the control circuitry 222 mounted on the second PCB 42. When the second PCB 42 is attached to the heater sub-assembly support frame 223, the components of control circuitry 222 mounted on the first and second PCBs are protected by the substrate of the second PCB 42, together with the heater sub-assembly support frame 223 divides the first volume, which is exposed to heat from the heater sub-assembly 21, from the second volume, containing the control circuitry 222 and the electrical power source 221. On the other hand, as shown in FIG. 4D, a reverse side of the second PCB 42, including the electrical contacts 44, is exposed to the first volume.

Figure 5A:
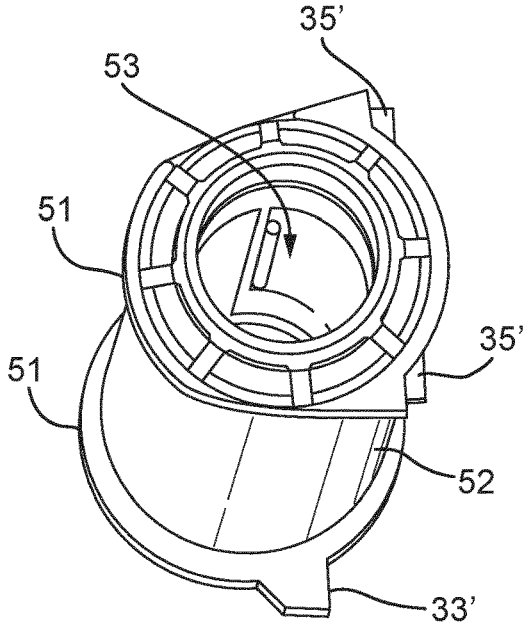
FIGS. 5A, 5B and 5C are schematic views of a heater sub-assembly.
Figure 5B:
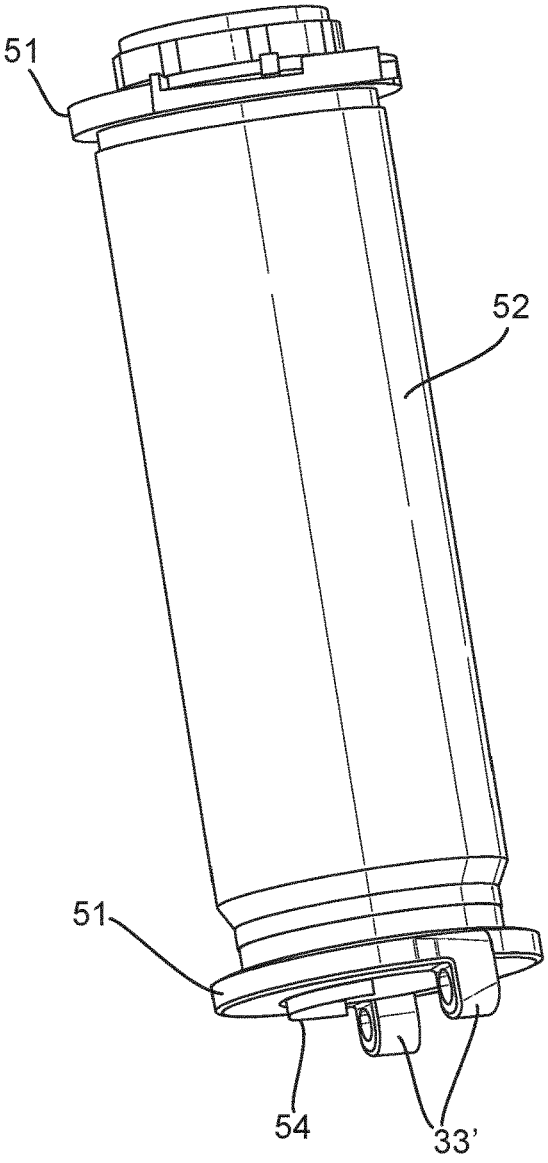
Figure 5C:
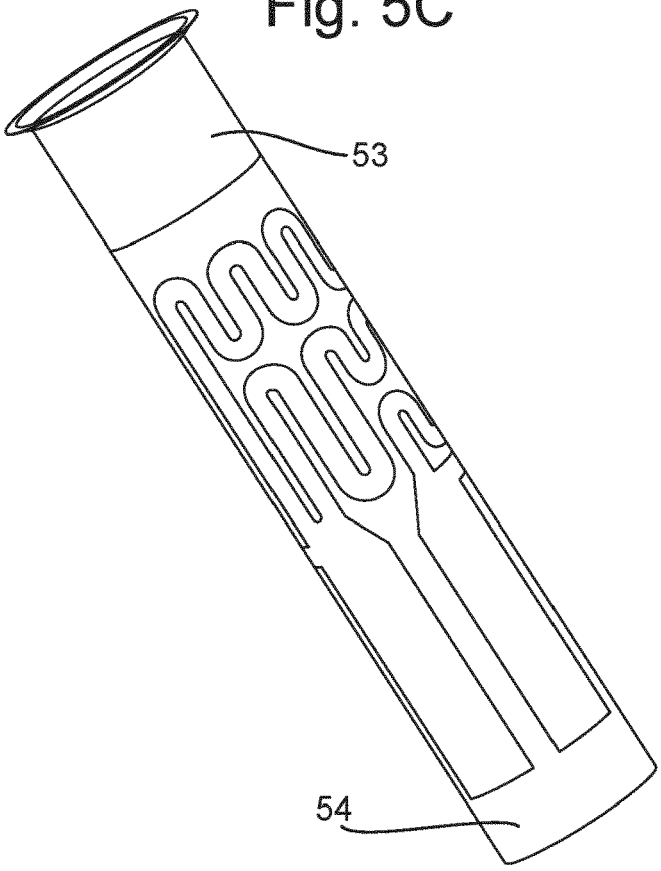

FIGS. 5A, 5B and 5C show some additional detail of the heater sub-assembly 21 as described below.

FIGS. 5A and 5B are end and side views respectively of the complete heater sub-assembly 21. Referring to FIGS. 5A and 5B, a heater end frame 51 is provided at each end of the heater sub-assembly 21 for supporting, aligning and attaching the heater sub-assembly. The heater end frames 51 include respective second guide members 33' and 35' for assisting alignment between the heater sub-assembly 21 and the power-and-control sub-assembly 22.

Between the heater end frames 51, an insulating sheath 52 is provided. The insulating sheath 52 surrounds a heating chamber 53 and a heater 54 which are shown separately in FIG. 5C. The heating chamber is an elongate chamber open at one end corresponding to the access sub-assembly 11 and comprises a thermally conductive material, such as metal, in order to conduct heat from the heater 54 wrapped around the outside of the heating chamber 53 to an aerosol substrate material in the heating chamber 53. The insulating sheath 52 is provided to insulate and contain the heat generated by the heater 54 so that the heat is more efficiently delivered to a heating chamber 53 and so that other components of the aerosol generation device 1 are less exposed to heat from the heater 54. In this embodiment, the heater sub-assembly 21 further comprises a temperature sensor for measuring a temperature in the heater sub-assembly.

The heater 54 and the temperature sensor have electrical contacts or connections to receive a power supply and to obtain measurements respectively.

Figure 6A:
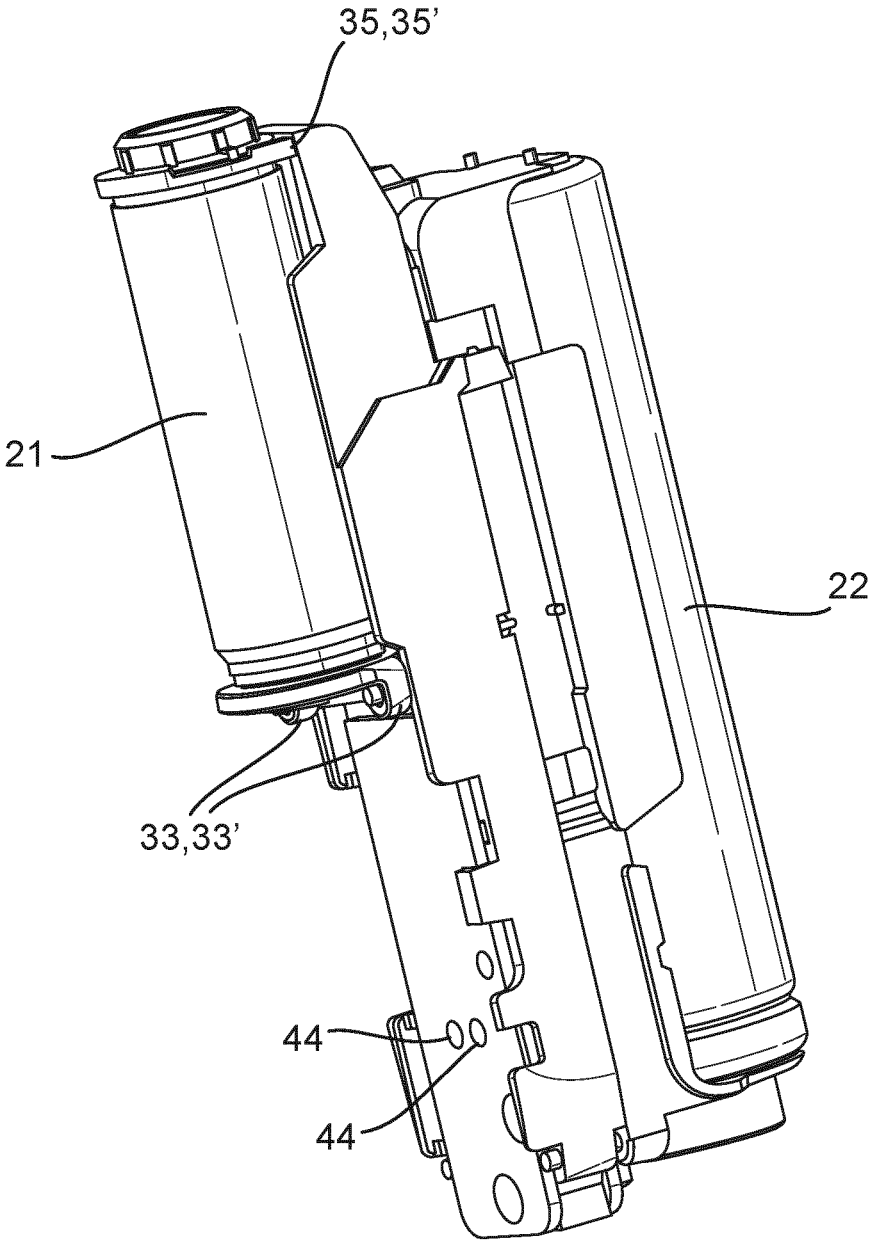
FIGS. 6A and 6B are schematic views of parts of the intermediate sub-assembly
Figure 6B:
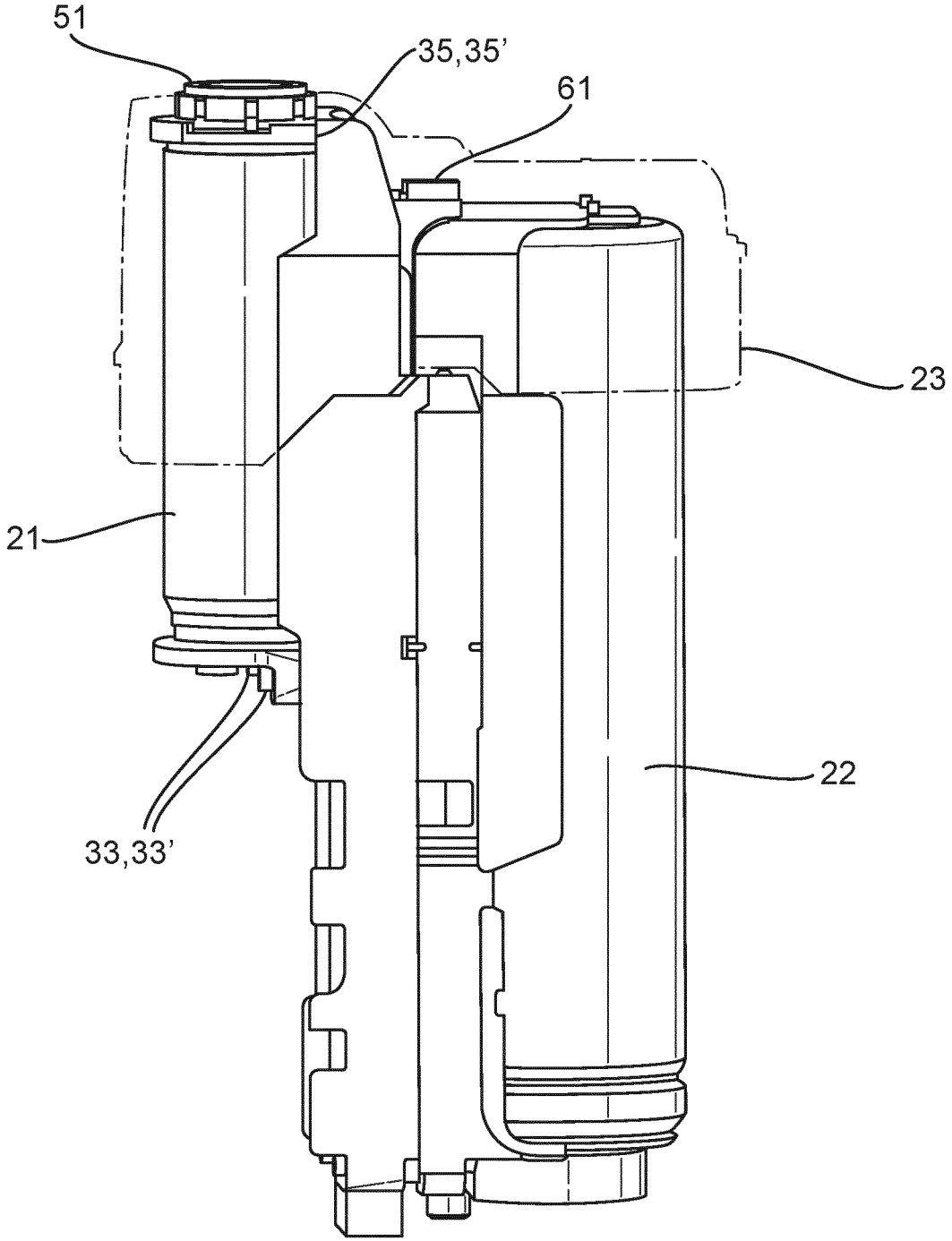

FIGS. 6A and 6B schematically illustrates how a mounting cap 23 is used to complete the intermediate sub-assembly 13.

As shown in FIG. 6A, the respective second guide members 33, 33', 35 and 35' of the heater sub-assembly 21 and the power and control sub-assembly 22 are aligned and fitted together. As with the first guide members, the second guide members may be protrusions or pins, and corresponding recesses or holes. As a result of this aligning and fitting, the heater sub-assembly 21 and the power and control sub-assembly 22 are correctly positioned but are not yet attached.

As shown in FIG. 6B, a mounting cap 23 (illustrated "transparently" with dashed lines) is arranged to fit over an end of the aligned heater sub-assembly 21 and power and control sub-assembly 22 in a longitudinal direction, at least partly covering the heater sub-assembly 21 and the power-and-control sub-assembly 22. The mounting cap 23 forms the top of an approximate T-shape frame assembly incorporating the heater sub-assembly support frame 223 and the electrical power source support frame 224 and may be arranged to close a top of the first to fifth volumes (where the "top" orientation is defined based on the orientation of the device as shown in FIG. 1A) when the intermediate sub-assembly 13 is housed in the housing sub-assembly 12. Thus, when the components of the intermediate sub-assembly 13 are suspended in the housing without touching the housing, this can be implemented by a direct or indirect attachment to the mounting cap 23.

The heater sub-assembly 21, the power-and-control sub-assembly 22 and the mounting cap 23 are adapted to interlock with each other such that, when the mounting cap 23 is arranged over the end, the heater sub-assembly 21 and power-and-control sub-assembly 22 are unable to separate from each other. In particular, in this embodiment, the mounting cap 23 is adapted to surround and partially cover the end of the aligned heater sub-assembly 21 and power-and-control sub-assembly 22 around the longitudinal direction, and the second guide members 33, 33', 35, 35' are arranged to prevent relative motion in the longitudinal direction between the heater sub-assembly 21 and the power-and-control sub-assembly 22 because this is transverse to the direction of the second guide members. Thus, by attaching the mounting cap 23 to one or both of the heater sub-assembly 21 and the power-and control sub-assembly 22, relative motion between the heater sub-assembly 21 and the power-and-control sub-assembly 22 is prevented both in the longitudinal direction, because this would be transverse to the direction of the second guide members, and around the longitudinal direction, because this would be either transverse to the direction of the second guide members or prevented by the covering and surrounding mounting cap. Thus, the heater sub-assembly 21 is fixed against the power-and-control sub-assembly 22.

In this embodiment, the mounting cap 23 is attached to the electrical power source support frame 224 of the power-and-control sub-assembly 22 at a mounting cap attachment point 61. Attachment may be performed using one or more reversible fastening means such as screws. By performing this attachment using a reversible fastening means, the heater sub-assembly 21 is more easily extracted for cleaning, although other embodiments use a a snap-fit or press-fit connection at the mounting cap attachment point 61.

It should be noted that the mounting cap 23 is not essential for fixing the heater sub-assembly 21 against the power-and-control sub-assembly 22, and, in other embodiments, such fixing may be performed by instead providing further snap-fit or press-fit connectors instead of or in addition to the second guide members 33, 33', 35, 35'. This alternative embodiment further reduces the number of components and steps required for manufacturing the aerosol generation device. Nevertheless, even if the mounting cap 23 is not used for fixing the heater sub-assembly 21 against the power-and-control sub-assembly 22, including the mounting cap 23 is advantageous for attaching the access sub-assembly 11 and the housing sub-assembly 12. In particular, the mounting cap 23 provides a modular attachment interface which is independent of the other components of the intermediate sub-assembly 13 and which can be adapted for convenient attachment to the device housing separately from any adaptation of the heater sub-assembly 21 and the power-and-control sub-assembly 22 for other purposes.

When the heater sub-assembly 21 has been fixed against the power-and-control sub-assembly 22 as shown in FIG. 6B, electrical connections such as wires can be easily installed between the heater sub-assembly 21 and the power-and-control sub-assembly 22 using the exposed electrical contacts 44 of the power-and-control sub-assembly 22 and the electrical contacts or connections of the heater 54 and the temperature sensor of the heater sub-assembly 21.

Figure 7A:
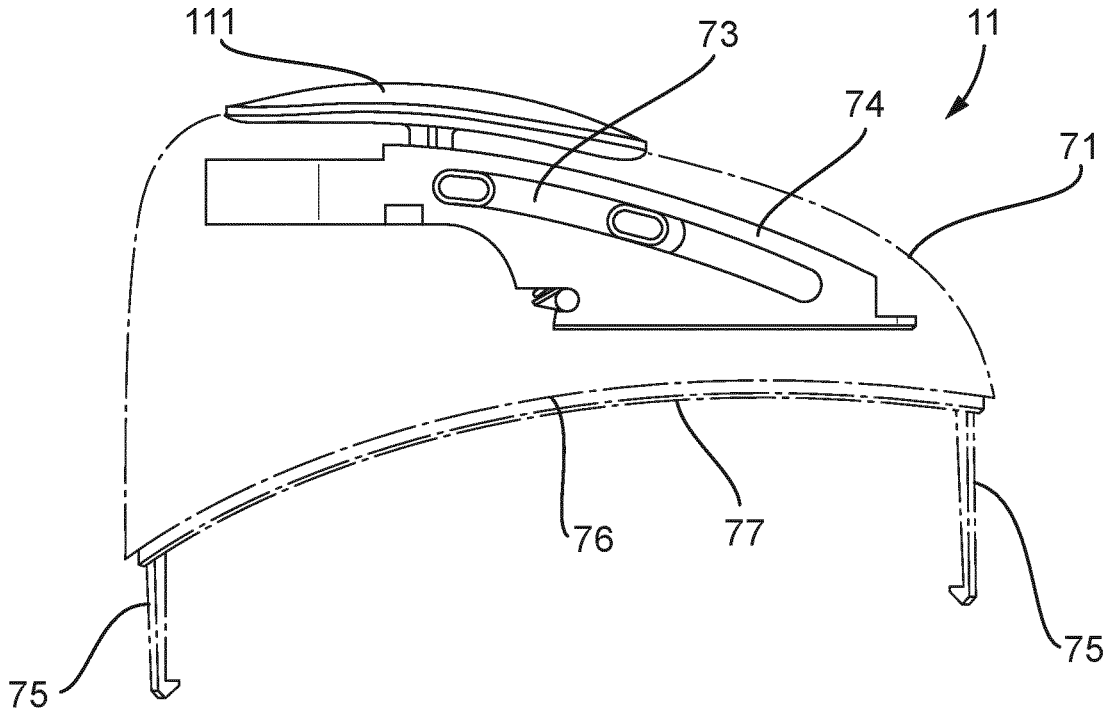
FIGS. 7A and 7B are schematic views of an access sub-assembly.
Figure 7B:
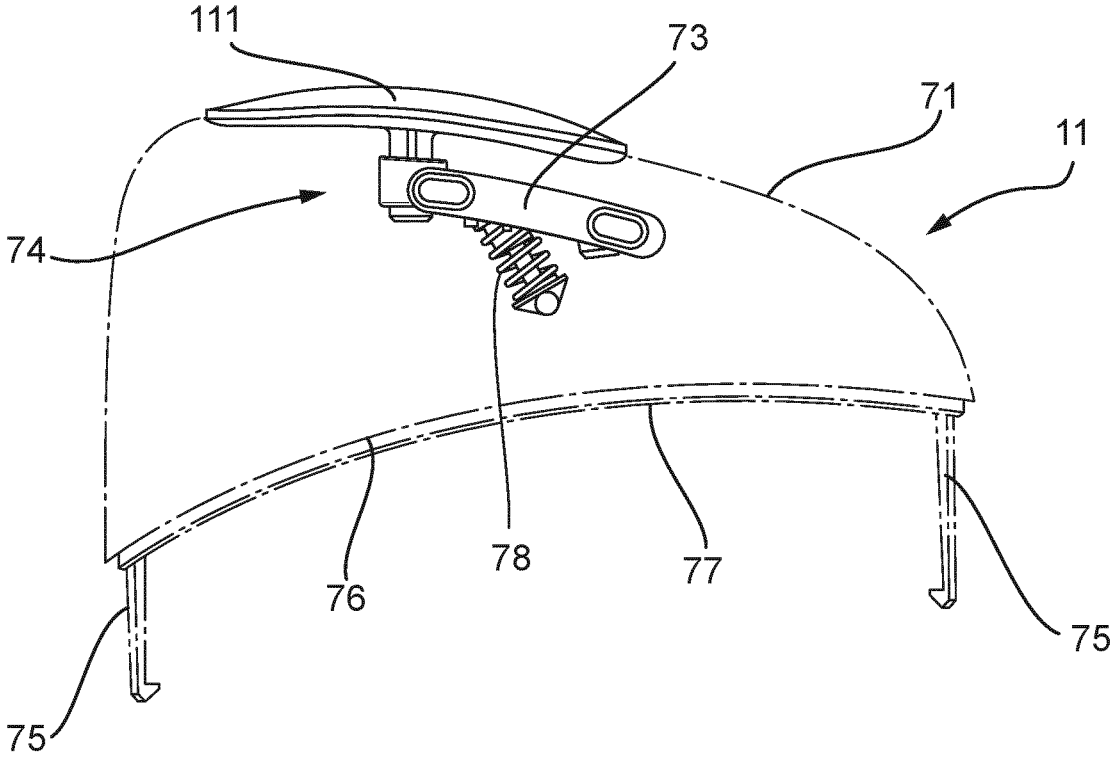

Referring now to FIGS. 7A and 7B, some additional detail of the access sub-assembly 11 is described.

FIG. 7A shows a view of the access sub-assembly 11 where an access housing 71 is made "transparent" (indicated with dashed lines) so that internal features of the access sub-assembly 11 can be more easily seen.

The lid 111 is attached to a slider cart 73. The slider cart is arranged to slide along a slider guide 74, such that the lid 111 slides between an open position and a closed position. In the closed position, an opening in the access housing 71 is blocked by the lid 111. In the open position, the opening in the access housing 71 is opened. When the aerosol generation device 1 is assembled and the lid 111 is in the open position, the opening in the access housing 71 provides access to the heating chamber 53.

As shown in FIG. 7A, the access housing 71 includes snap-fit connectors 75 for attaching the access sub-assembly 11 to the intermediate sub-assembly 13. In this embodiment, two opposing snap-fit connectors 75 are provided corresponding to the two smaller opposing sides of the aerosol generation device 1, although any effective arrangement of connectors can be used. As with the previously-mentioned snap-fit connectors, the snap-fit connectors may alternatively be press-fit connectors.

Additionally, the access housing 71 includes a stepped rim along its bottom edge (as shown in the figure). An inner rim 77 extends downwards beyond an outer rim 76. This stepped rim helps to secure the access sub-assembly 11 together with the housing sub-assembly 12, and can divert impact stress away from the snap-fit connectors 75 thereby helping to prevent a weak point in the structure at the join between the access sub-assembly 11 and the intermediate sub-assembly 13.

Turning to FIG. 7B, in this figure the slider guide 74 is hidden, providing a better view of a slider biasing mechanism 78 that acts to return the slider cart 73 and lid 111 to the closed position. This helps to ensure that the heating chamber 53 is covered when it is not in use.

Definitions and Alternative Embodiments It will be appreciated from the description above that many features of the described embodiment perform independent functions with independent benefits. Therefore the inclusion or omission of each of these independent features from embodiments of the invention defined in the claims can be independently chosen.

For example, in the above-described embodiment, a specific design of power-and-control sub-assembly 22 comprising multiple PCBs is used. Alternatively, in other embodiments, the control circuitry 222 may be provided without using a PCB, particularly in the case where control is simple, such as in the very simple case of a switch and impedance setting circuitry in order to turn the heater on and off. Alternatively, embodiments of the invention may have only one of the first PCB 31 and the second PCB 42 as described above.

The term "heater" should be understood to mean any device for outputting thermal energy sufficient to form an aerosol from the aerosol substrate. The transfer of heat energy from the heater 54 to the aerosol substrate may be conductive, convective, radiative or any combination of these means. As non-limiting examples, conductive heaters may directly contact and press the aerosol substrate, or they may contact a separate component such as the heating chamber which itself causes heating of the aerosol substrate by conduction, convection, and/or radiation.

Heaters may be electrically powered, powered by combustion, or by any other suitable means. Electrically powered heaters may include resistive track elements (optionally including insulating packaging), induction heating systems (e.g. including an electromagnet and high frequency oscillator), etc. The heater 54 may be arranged around the outside of the aerosol substrate, it may penetrate part way or fully into the aerosol substrate, or any combination of these. For example, instead of the heater of the above-described embodiment, an aerosol generation device may have a blade-type heater that extends into an aerosol substrate in the heating chamber.

The term "temperature sensor" is used to describe an element which is capable of determining an absolute or relative temperature of a part of the aerosol generation device 1. This can include thermocouples, thermopiles, thermistors and the like. The temperature sensor may be provided as part of another component, or it may be a separate component. In some examples, more than one temperature sensor may be provided, for example to monitor heating of different parts of the aerosol generation device 1, e.g. to determine thermal profiles. Alternatively, in some examples, no temperature sensor is included; for example, this would be possible where thermal profiles have already been reliably established and a temperature can be assumed based on operation of the heater 54.

The control circuitry 222 in the figures is shown as having a single user operable button to trigger the aerosol generation device 1 to turn on. This keeps the control simple and reduces the chances that a user will misuse the aerosol generation device 1 or fail to control the aerosol generation device 1 correctly. In some cases, however, the input controls available to a user may be more complex than this, for example to control the temperature, e.g. within pre-set limits, to change the flavour balance of the vapour, or to switch between power saving or quick heating modes, for example.

Aerosol substrate includes tobacco, for example in dried or cured form, in some cases with additional ingredients for flavouring or producing a smoother or otherwise more pleasurable experience. In some examples, the aerosol substrate such as tobacco may be treated with a vaporising agent. The vaporising agent may improve the generation of vapour from the aerosol substrate. The vaporising agent may include, for example, a polyol such as glycerol, or a glycol such as propylene glycol. In some cases, the aerosol substrate may contain no tobacco, or even no nicotine, but instead may contain naturally or artificially derived ingredients for flavouring, volatilisation, improving smoothness, and/or providing other pleasurable effects. The aerosol substrate may be provided as a solid or paste type material in shredded, pelletised, powdered, granulated, strip or sheet form, optionally a combination of these. Equally, the aerosol substrate may be a liquid or gel. Indeed, some examples may include both solid and liquid/gel parts.

Consequently, the aerosol generation device 1 could equally be referred to as a "heated tobacco device", a "heat-not-burn tobacco device", a "device for vaporising tobacco products", and the like, with this being interpreted as a device suitable for achieving these effects. The features disclosed herein are equally applicable to devices which are designed to vaporise any aerosol substrate.

The aerosol generation device 1 may be arranged to receive the aerosol substrate in a pre-packaged substrate carrier. The substrate carrier may broadly resemble a cigarette, having a tubular region with an aerosol substrate arranged in a suitable manner. Filters, vapour collection regions, cooling regions, and other structure may also be included in some designs. An outer layer of paper or other flexible planar material such as foil may also be provided, for example to hold the aerosol substrate in place, to further the resemblance of a cigarette, etc. The substrate carrier may fit within the heating chamber 53 or may be longer than the heating chamber 53 such that the lid 111 remains open while the aerosol generation device 1 is provided with the substrate carrier. In such embodiments, the aerosol may be provided directly from the substrate carrier which acts as a mouthpiece for the aerosol generation device.

As used herein, the term "fluid" shall be construed as generically describing non-solid materials of the type that are capable of flowing, including, but not limited to, gases, liquids, pastes, gels, powders and the like. "Fluidized materials" shall be construed accordingly as materials which are inherently, or have been modified to behave as, fluids. Fluidization may include, but is not limited to, powdering, dissolving in a solvent, gelling, thickening, thinning and the like.

As used herein, the term "volatile" means a substance capable of readily changing from the solid or liquid state to the gaseous state. As a non-limiting example, a volatile substance may be one which has a boiling or sublimation temperature close to room temperature at ambient pressure. Accordingly "volatilize" or "volatilise" shall be construed as meaning to render (a material) volatile and/or to cause to evaporate or disperse in vapour.

As used herein, the term "vapour" (or "vapor") means: (i) the form into which liquids are naturally converted by the action of a sufficient degree of heat; or (ii) particles of liquid/moisture that are suspended in the atmosphere and visible as clouds of steam/smoke; or (iii) a fluid that fills a space like a gas but, being below its critical temperature, can be liquefied by pressure alone.

Consistently with this definition the term "vaporise" (or "vaporize") means: (i) to change, or cause the change into vapour; and (ii) where the particles change physical state (i.e. from liquid or solid into the gaseous state).

As used herein, the term "atomise" (or "atomize") shall mean: (i) to turn (a substance, especially a liquid) into very small particles or droplets; and (ii) where the particles remain in the same physical state (liquid or solid) as they were prior to atomization.

As used herein, the term "aerosol" shall mean a system of particles dispersed in the air or in a gas, such as mist, fog, or smoke. Accordingly the term "aerosolise" (or "aerosolize") means to make into an aerosol and/or to disperse as an aerosol. Note that the meaning of aerosol/aerosolise is consistent with each of volatilise, atomise and vaporise as defined above. For the avoidance of doubt, aerosol is used to consistently describe mists or droplets comprising atomised, volatilised or vaporised particles. Aerosol also includes mists or droplets comprising any combination of atomised, volatilised or vaporised particles.

The invention claimed is:

1. An aerosol generation device, comprising:
an electrical power source;
a heating chamber;
a heater arranged to supply heat to the heating chamber;
control circuitry configured to control a supply of electrical power from the electrical power source to the heater;
a frame; and
a housing having an internal volume containing the electrical power source, the heating chamber, the heater, the control circuitry and the frame,
wherein the frame is arranged between a first volume of the internal volume containing the heater and the heating chamber, and a second volume of the internal volume containing the electrical power source, and
wherein the heating chamber and the heater are held by the frame such that the heating chamber and the heater do not touch the housing.

2. The aerosol generation device of claim 1, wherein the housing is an elongate housing for handholding, and the first volume, the frame and the second volume are each arranged along an elongate direction of the housing.

3. The aerosol generation device of claim 1, wherein the first volume contains a region of air or vacuum adjacent to the heating chamber.

4. The aerosol generation device of claim 1, wherein the electrical power source and the control circuitry are held by the frame.

5. An aerosol generation device comprising:
an electrical power source;
a heating chamber;
a heater arranged to supply heat to the heating chamber;
control circuitry configured to control a supply of electrical power from the electrical power source to the heater;
a frame; and
a housing having an internal volume containing the electrical power source, the heating chamber, the heater, the control circuitry and the frame,
wherein the frame is arranged between a first volume of the internal volume containing the heater and the heating chamber, and a second volume of the internal volume containing the electrical power source, and
wherein the control circuitry comprises a component mounted on a first PCB that is arranged along the frame and in the second volume,
the aerosol generation device further comprising a second PCB that is arranged along the frame and between the first volume and the second volume.

6. The aerosol generation device of claim 5, wherein the first PCB is a double-sided PCB.

7. The aerosol generation device of claim 5, wherein the second PCB is a single-sided PCB and the control circuitry further comprises a component mounted on the second PCB and in the second volume.

8. The aerosol generation device of claim 5, wherein the first PCB and the second PCB are connected by a flexible PCB portion, and the first PCB, the second PCB and the flexible PCB portion are arranged around the frame.

9. The aerosol generation device according to claim 1, wherein the first volume of the internal volume contains the control circuitry.

10. The aerosol generation device of claim 9, wherein the frame is arranged to prevent fluid flow from the second volume to the first volume.

11. The aerosol generation device of claim 9, wherein the electrical power source is held by the frame.

12. The aerosol generation device according to claim 1, further comprising:

a second frame arranged between a first part of the second volume containing the control circuitry and a second part of the second volume containing the electrical power source.

13. The aerosol generation device of claim 12, wherein the control circuitry comprises a component mounted on a PCB held between the frame and the second frame.

* * * * *